United States Patent [19]

Smirnov et al.

[11] 4,079,612

[45] Mar. 21, 1978

[54] ARRANGEMENT FOR EXPLOSION TREATMENT OF MATERIALS

[76] Inventors: Polikarp Polikarpovich Smirnov, ulitsa Ordzhonikidze, 33, kv. 44; Viktor Matveevich Soitu, ulitsa Sofiiskaya, 48, korpus 2, kv. 71, both of Leningrad; Andrei Andreevich Deribas, ulitsa Pravdy, 1, kv. 20; Alexandr Fedorovich Demchuk, ulitsa Tereshkovoi, 12, kv. 6, both of Novosibirsk, all of U.S.S.R.

[21] Appl. No.: 727,343

[22] Filed: Sep. 28, 1976

[51] Int. Cl.[2] ..... B21D 26/08

[52] U.S. Cl. ..... 72/56; 29/421 E; 72/DIG. 24

[58] Field of Search ..... 72/56, 63, 419, DIG. 24, 72/DIG. 25; 29/421 E

[56] References Cited

U.S. PATENT DOCUMENTS

| | | | |
|---|---|---|---|
| 3,611,766 | 10/1971 | Klein | 72/56 |
| 3,631,701 | 1/1972 | Hertel | 72/56 |
| 3,974,673 | 8/1976 | Fosress | 72/56 |

*Primary Examiner*—Leon Gilden

*Attorney, Agent, or Firm*—Fleit & Jacobson

[57] ABSTRACT

The invention relates to the production equipment to be used for explosion treatment of materials. An detonation chamber or arrangement for explosion treatment of materials comprises a chamber consisting of two metal casings received in each other with a sound insulating layer therebetween. The chamber accommodates a work table consisting of metal slabs with spacers therebetween. In addition, the arrangement comprises a charge initiation system and a system for ventilating the working space of the chamber. According to the invention, the acoustic stiffness of the spacers differs from the acoustic stiffness of the slabs proper, the slabs being, in turn, interconnected. The arrangement is designed for conducting production processes with the explosion treatment of materials and may be used in conventional production work-shops.

6 Claims, 1 Drawing Figure

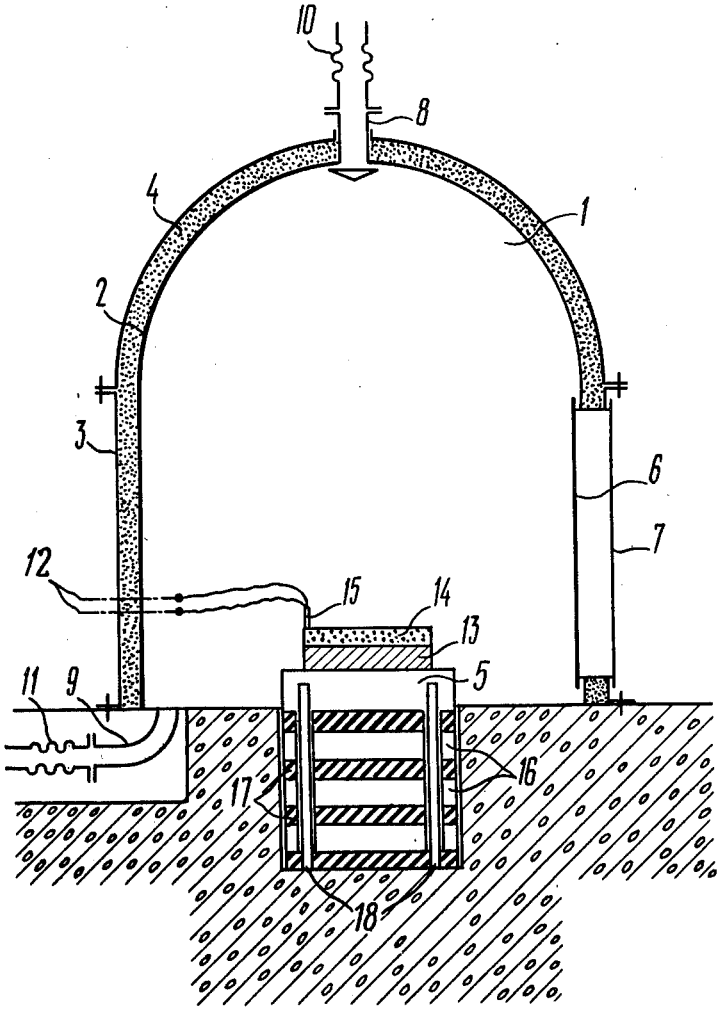
10
8
4
1
2
3
6
7
12
15
14
13
5
11
9
16
17
18

ARRANGEMENT FOR EXPLOSION TREATMENT OF MATERIALS

The invention relates to arrangements for explosion treatment of materials to be used in ferrous and non-ferrous metallurgy, various branches of mechanical engineering and in other industries.

The explosion treatment of materials is effected in the following manner. Working sites are arranged in an open land at spaced apart locations, and the working sites are equipped with all necessary devices to carry out the explosion treatment of materials. The spacing between the working sites represents, in this case, the protective measure against explosion effects, such as air blasting, spray of detonation products and debries of material formed during the explosion.

In other applications, underground chambers (abandoned mountain excavations and tunnels, natural caves and the like) are used for explosion operations associated with treatment of materials. Generally all preparatory operations are carried out in conventional industrial buildings, and the explosion works are conducted in underground chambers.

It is also known to use reinforced concrete surface explosion chambers designed to carry out experimental explosion operations. Reinforced concrete explosion chambers are made in the form of hemispherical shells supported with their end faces on a flat reinforced concrete foundation.

Known in the art is an arrangement for explosion treatment of materials comprising a work table accommodated in a chamber, a material to be treated being placed on the table, an explosive charge and a device for initiating the explosive charge, the chamber also having a specific charge initiation system. The arrangement is provided with a system for ventilating the working space of the chamber. The table consists of several slabs separated by spacers.

It should be, however, noted that the explosion treatment of materials on open-air sites depends on weather conditions and season. Working on open-air sites in winter is very difficult. In addition, the arrangement of working sites requires a large surface area.

Operation in underground chambers is complicated because of confined work space, and the chambers are remotely located from the main production plant.

Reinforced concrete chambers have a short service life under intensive operation and represent sources of seismic oscillations.

Neither of the above-described arrangements provides for sufficiently comprehensive mechanization of the explosion treatment process nor enables convenient operating conditions and compliance with sanitary rules stipulating labour conditions of operation staff.

The chamber accommodating a work table consisting of several superposed slabs separated by spacers is deficient in that, when using the spacers made of materials having the acoustic stiffness greater than or equal to the acoustic stiffness of the slabs, the work table is destroyed upon just first explosions. Therefore, the whole arrangement is unproductive.

The invention consists in the provision of the construction of the work table in an arrangement for explosion treatment of materials which improves durability and productivity of the arrangement as a whole.

This object is accomplished by that in an arrangement for explosion treatment of materials comprising a chamber accommodating a work table consisting of several superposed slabs separated by spacers, a material to be treated being placed on the table, an explosive charge and a device for initiating the explosive charge, as well as a ventilation system, according to the invention, the acoustic stiffness of the spacers differs from the acoustic stiffness of the slabs proper which are interconnected.

The acoustic stiffness of the spacers is preferably lower than the acoustic stiffness of the slabs.

This offers an opportunity of providing an arrangement for explosion treatment of materials which has an improved performance because the structural arrangement of the table according to the invention enables repeated use of the table which, in turn, permits the arrangement for explosion treatment of materials according to the invention to be incorporated in a production line of a conventional workshop.

The invention will now be described with reference to a specific embodiment illustrated in the accompanying drawing which shows an arrangement for explosion treatment of materials.

The arrangement for explosion treatment of materials according to the invention has a chamber 1. The chamber 1 is formed of two metal casings 2 and 3 received in each other with a sound insulating layer 4 therebetween, which may consists, e.g. of sand. A work table 5 is mounted within the chamber 1, in the bottom portion thereof. The chamber 1 has a door opening which is closed by a force-absorbing door 6 and a sealing door 7. The force-absorbing door 6 takes-up the loads from the explosion of a charge in the chamber 1, and the door 7 seals-off the working space of the chamber from the ambient space. The chamber 1 has a ventilation system which is shown in the drawing in the form of two pipes 8 and 9 connected to delivery and discharge conduits (not shown). Shock absorbers 10 and 11 are inserted between the pipes 8 and 9 and the delivery and discharge conduits so as to prevent the transmission of high-frequency oscillations from the chamber 1 to the conduits. In addition, the chamber 1 is provided with a system 12 for initiating the explosive charge as shown with dash-and-dot lines in the drawing.

A material 13 to be treated combined with an explosive charge 14 is placed in the chamber 1 on the work table 5. An initiating device 15, such as an electric detonator is connected to the explosive charge 14.

The work table 5 consists of metal slabs 16 with spacers 17 therebetween, the acoustic stiffness of the spacers being different from the acoustic stiffness of the slabs 16. The slabs 16 are movably interconnected, such as by means of metal rods 18. Upon an explosion, the rods 18 permit the slabs 16 to move closer or apart, while, at the same time, preventing the work table from decomposing into the component members of which it is built.

After the explosion of the explosive charge 14 in the chamber 1, a strong blast wave propagates within the body of the work table 5. Thus, in case the work table 5 is made of a homogeneous material, such as of metal, high stresses would appear to result in destruction of the work table. In order that the blast wave can be effectively damped within the body of the work table 5, the work table should be constructed of layers having different acoustic stiffness. The acoustic stiffness of the slabs 16 and the spacers 17 may be considerably different. The greater the difference in the acoustic stiffness of the slabs 16 and the spacers 17, the better the damping of blast wave within the body of the work table 5 and the greater the productivity of the arrangement as a whole.

The acoustic stiffness of the material of the spacers 17 should be preferably lower than the acoustic stiffness of the material of the slabs 16. As examples of the material for making the spacers 17 for the work table 5 the reference can be made to technical rubber and loose media (metal shot, sand and the like).

The arrangement for explosion treatment of materials functions in the following manner. The material 13 to be treated combined with the explosive charge 14 is fed into the chamber 1 through the open doors 6 and 7 manually or by an appropriate mechanism. The explosive charge 14 is armed with a device 15 for initiating the charge. As mentioned above, the device for initiating the charge may comprise a standard electric detonator. The specific example illustrated in the drawing shows just such electric detonator. The initiating device 15 (electric detonator) is connected by means of conductors to the initiation system 12. Then the force-absorbing door 6 and the sealing door 7 are closed. Electric tension is applied to the device 15 for initiating the charge 14 via the initiation system 12. The charge 14 is blown-up thereby treating the material 13. During the explosion, the internal casing 2 of the chamber 1 takes-up the impulse loads. The outer casing 3 of the chamber 1 and the sound insulating layer serve for partial unloading of the inner casing 2 and for lowering the acoustic effect of the chamber 1 as a whole.

During the explosion, the rods 18 prevent the work table from decomposing into component members of which it is built.

After the explosion of the charge 14, the working space of the chamber 1 is cleaned from detonation products by means of the ventilation system. Air is admitted to the chamber 1 via the delivery conduit, the pipe 9 and shock absorber 11, and the detonation products mixed with air are removed from the chamber 1 via the pipe 8, shock absorber 10 and discharge conduit. Then the doors 7 and 6 are opened and the treated material 13 is withdrawn from the chamber 1 manually or by means of an appropriate mechanism. Further the above-described cycle may be repeated.

The arrangement according to the invention offers wide capabilities and enables the provision of highly productive manufacturing equipment. In addition, the arrangement for explosive treatment of materials according to the invention may be incorporated in the production line of a conventional workshop so that the production processes associated with explosion treatment may be very efficiently conducted.

What is claimed is:

1. An explosion chamber for explosion treatment of materials comprising: a chamber; a work table mounted in said chamber, said table having at least three superposed spaced apart rigid slabs interconnected in each other; spacer layers placed between said spaced apart rigid slabs, the acoustic stiffness of said spacer layers being different from the acoustic stiffness of said slabs; means for initiating an explosive charge for effecting the explosion; and a ventilation system operatively associated with said chamber.

2. An explosion chamber as claimed in claim 1, wherein the acoustic stiffness of the material of said spacer layers is lower than the acoustic stiffness of the material of said slabs.

3. An explosion chamber as claimed in claim 1 wherein said ventilation system further comprises: a conduit for delivering air to said chamber; and a conduit for removing air from said chamber; each of said conduits including means for absorbing shockwaves generated by an explosion within said chamber.

4. An explosion chamber as claimed in claim 1 wherein said chamber comprises two interconnected metal casings having an insulating layer therebetween.

5. An explosion chamber as claimed in claim 1 wherein said slabs are formed of a metallic material and each of said slabs has a plurality of openings therein, said slabs being interconnected by metallic rods extending through said openings.

6. An explosion chamber as claimed in claim 2 wherein at least one of said spacer layers is formed of a plurality of discrete particles and said work table further comprises means for retaining said particles between said slabs.

* * * * *